US012078406B2

(12) United States Patent
Han

(10) Patent No.: US 12,078,406 B2
(45) Date of Patent: Sep. 3, 2024

(54) REFRIGERATOR

(71) Applicant: LG Electronics Inc., Seoul (KR)

(72) Inventor: Junghoon Han, Seoul (KR)

(73) Assignee: LG Electronics Inc., Seoul (KR)

( * ) Notice: Subject to any disclaimer, the term of this patent is extended or adjusted under 35 U.S.C. 154(b) by 281 days.

(21) Appl. No.: 17/565,166

(22) Filed: Dec. 29, 2021

(65) Prior Publication Data

US 2022/0214096 A1 Jul. 7, 2022

(30) Foreign Application Priority Data

Jan. 7, 2021 (KR) ..... 10-2021-0002220

(51) Int. Cl.
*F25D 23/02* (2006.01)

(52) U.S. Cl.
CPC ..... *F25D 23/028* (2013.01); *F25D 23/02* (2013.01); *F25D 2323/021* (2013.01); *F25D 2400/18* (2013.01)

(58) Field of Classification Search
CPC .. F25D 23/028; F25D 23/02; F25D 2323/021; F25D 2400/18; F25D 2323/02; E05B 1/0053; E05B 7/00; E05F 11/54; E05Y 2201/68; E05Y 2800/11; E05Y 2900/31
See application file for complete search history.

(56) References Cited

U.S. PATENT DOCUMENTS 7,984,955 B2 * 7/2011 Jung ..... F25D 23/028 312/319.2
8,025,349 B2 * 9/2011 Lim ..... F25D 23/028 312/319.2
9,010,889 B2 * 4/2015 Jung ..... F25D 17/042 312/404
9,127,879 B2 * 9/2015 Hwang ..... F25D 23/00
9,506,685 B2 * 11/2016 Park ..... F25D 23/028
10,281,194 B2 * 5/2019 Choo ..... F25D 23/025
(Continued)

FOREIGN PATENT DOCUMENTS

CN 2539111 Y * 3/2003
CN 200989706 Y * 12/2007
(Continued)

OTHER PUBLICATIONS

Extended European Search Report in European Appln. No. 21217969.1, dated May 25, 2022, 9 pages.

*Primary Examiner* — Hanh V Tran
(74) *Attorney, Agent, or Firm* — Fish & Richardson P.C.

(57) ABSTRACT

A refrigerator includes a cabinet defining a storage space, a door configured to open and close the storage space, and a door opening device provided on the door and configured to open the door. The door opening device includes a case provided inside the door and in communication with openings on the front and rear surfaces of the door, a door handle mounted inside the case and configured to be rotated by a user and to shield an opening in the front surface of the door, and a push slider accommodated in the case and configured to reciprocate in a straight line, and having one end in contact with the door handle and the other end that protrudes through an opening at the rear surface of the door. The push slider moves rearward when the door handle is rotated and pushes the cabinet to open the door.

20 Claims, 16 Drawing Sheets

(56) References Cited

U.S. PATENT DOCUMENTS

| | | | | |
|---|---|---|---|---|
| 11,359,414 | B2 * | 6/2022 | Ayyawar | E05C 7/02 |
| 11,680,743 | B2 * | 6/2023 | Son | E05B 17/0033 312/405 |
| 2008/0284301 | A1 * | 11/2008 | Kim | F25D 23/028 312/405 |
| 2009/0179540 | A1 * | 7/2009 | Seo | E05B 17/0033 312/405 |
| 2009/0205357 | A1 * | 8/2009 | Lim | F25D 23/021 62/449 |
| 2010/0101267 | A1 * | 4/2010 | Jung | E05B 17/0033 62/449 |
| 2011/0050066 | A1 * | 3/2011 | Lee | F25D 23/028 312/404 |
| 2011/0273070 | A1 * | 11/2011 | Shin | F25D 23/028 312/405 |
| 2012/0280608 | A1 * | 11/2012 | Park | E05B 1/0015 49/460 |
| 2013/0113357 | A1 | 5/2013 | Park et al. | |
| 2015/0233154 | A1 * | 8/2015 | Smart | E05B 85/107 70/237 |
| 2015/0275545 | A1 * | 10/2015 | Lee | F25D 23/028 49/460 |
| 2019/0024965 | A1 * | 1/2019 | Park | E05F 11/54 |
| 2019/0186809 | A1 * | 6/2019 | Scalf | F24C 15/024 |

FOREIGN PATENT DOCUMENTS

| | | | | | |
|---|---|---|---|---|---|
| CN | 203132254 | U | * | 8/2013 | |
| CN | 203308181 | U | * | 11/2013 | |
| CN | 104864669 | A | * | 8/2015 | |
| CN | 106013955 | A | * | 10/2016 | E05B 1/0015 |
| CN | 106369920 | A | * | 2/2017 | F25D 11/00 |
| CN | 106440643 | A | * | 2/2017 | |
| CN | 206131599 | U | * | 4/2017 | |
| CN | 107062775 | A | * | 8/2017 | F25D 23/028 |
| CN | 108756461 | A | * | 11/2018 | E05B 1/0015 |
| CN | 109403717 | A | * | 3/2019 | E05B 1/0015 |
| CN | 208871956 | U | * | 5/2019 | F25D 23/028 |
| CN | 209324153 | U | * | 8/2019 | |
| CN | 211692344 | U | * | 10/2020 | |
| CN | 212299105 | U | * | 1/2021 | |
| DE | 102013103820 | A1 | * | 10/2014 | F25D 23/028 |
| EP | 2078909 | | | 7/2009 | |
| EP | 2078909 | A2 | * | 7/2009 | E05B 17/0033 |
| EP | 2093528 | | | 8/2009 | |
| EP | 2182311 | | | 5/2010 | |
| EP | 2182311 | A2 | * | 5/2010 | E05B 17/0033 |
| EP | 2299215 | | | 3/2011 | |
| EP | 2385331 | A1 | * | 11/2011 | F25D 23/028 |
| EP | 1102952 | B1 | * | 4/2012 | E05B 1/0015 |
| EP | 2562498 | | | 2/2013 | |
| EP | 3936798 | A1 | * | 1/2022 | F25D 23/028 |
| GB | 2506350 | A | * | 4/2014 | E05B 5/003 |
| JP | H04135431 | U | * | 12/1992 | |
| JP | H1073367 | A | * | 3/1998 | |
| JP | 3679003 | B2 | * | 8/2005 | E05B 1/0015 |
| JP | 2006010124 | | | 1/2006 | |
| JP | 3871474 | B2 | * | 1/2007 | |
| KR | 19990019290 | A | * | 3/1999 | |
| KR | 20030042355 | A | * | 5/2003 | |
| KR | 20090074442 | A | * | 7/2009 | |
| KR | 101334477 | | | 12/2013 | |
| KR | 101652527 | | | 8/2016 | |

* cited by examiner

REFRIGERATOR

CROSS-REFERENCE TO RELATED APPLICATIONS

The present application claims priority under 35 U.S.C. 119 and 35 U.S.C. 365 to Korean Patent Application No. 10-2021-0002220, filed on Jan. 7, 2021, which is hereby incorporated by reference in its entirety.

BACKGROUND

The present disclosure relates to a refrigerator.

In general, a refrigerator is a home appliance that can store food at a low temperature in an internal storage space that is shielded by a door. To this end, the refrigerator is configured to store the stored food in an optimal state by cooling the inside of the storage space using cold air generated through heat exchange with the refrigerant circulating in the refrigeration cycle.

Recently, refrigerators are gradually becoming larger and more multifunctional according to changes in dietary habits and the trend of luxury products, and refrigerators having various structures and convenient devices that allow users' convenience and efficient use of internal space are being released.

Typically, the door of the refrigerator becomes heavy due to the enlargement of the refrigerator and arrangement of items inside the refrigerator. In addition, a gasket that is airtight in contact with the cabinet may be provided around the refrigerator door, and a magnet may be embedded in the gasket so that the gasket is more closely attached to the cabinet.

Therefore, in order to open the refrigerator door, the heavy refrigerator door is manipulated, and in particular, the opening manipulation must be performed with a greater force than the magnetic force of a magnet embedded in the gasket. In addition, when the door is opened, a negative pressure inside the storage space is generated, so that a greater force is required to open the refrigerator door, and thus there is a problem that causes inconvenience in use of the user.

In order to solve this problem, refrigerators having a door opening structure that facilitates door opening by pushing a cabinet inside a protruding door handle is disclosed in Korean Patent Registration Nos. 10-1652527 and 10-1334477.

However, there is a problem that can be applied only to a structure in which the door handle protrudes in such conventional techniques.

SUMMARY

An object of an embodiment of the present disclosure is to provide a refrigerator that facilitates opening of a door having a flat front surface.

An object of an embodiment of the present disclosure is to provide a refrigerator that facilitates opening of a door configured to allow a door handle to selectively protrude.

An object of an embodiment of the present disclosure is to provide a refrigerator capable of opening a door with less force.

A refrigerator according to an embodiment of the present disclosure includes a cabinet in which a storage space is formed, a door configured to open and close the storage space, and a door opening device configured to be provided on the door and manipulated to open the door, in which the door opening device includes a case configured to be provided inside the door and to communicate with openings on the front and rear surfaces of the door, a door handle configured to be mounted inside the case to be rotated by a user's manipulation and to shield an opening in the front surface of the door, and a push slider accommodated in the case so as to reciprocate in a straight line, and having one end which is in contact with the door handle and the other end which protrudes through an opening at the rear surface of the door, and in which the push slider may move rearward when the door handle is rotated and pushes the cabinet to open the door.

A hinge device may be provided at an upper end and a lower end of the door so that the door is rotatably connected to the cabinet, and the door opening device may be provided at one end of both ends of the door in the left and right direction, which is far from the hinge device.

The door may include a door plate configured to form an outer appearance of the door, a door liner configured to form a rear surface of the door, a cap decoration configured to connect upper and lower ends of the door plate and the door line, and an insulation material filled between the door plate, the door liner, and the cap decoration, and the case may form an accommodation space in which penetration of the insulation material is prevented.

A gasket which is in contact with the cabinet and seals the space between the storage space and the door may be provided around of the rear surface of the door liner.

The push slider may protrude through the rear surface of the door from an outside of the gasket.

The case may form the accommodation space in contact with the front and side surfaces of the door, and the accommodation space may form a space in which the door handle rotates and the push slider reciprocates.

A plate opening having a size corresponding to that of the door handle may be formed in the door plate, and the plate opening may communicate with the accommodation space and the door handle may shield the plate opening.

In a state where the door handle is not manipulated, the front surface of the door handle may shield the opening of the door plate and form the same plane as the front surface of the door plate.

The door plate may include a front part forming a front surface of the door, side parts forming side surfaces of the door, and a coupling part bent at the side part to form a circumference of the rear surface of the door and coupled to the door liner, and in which a slider outlet through which the push slider protrudes may be formed in the coupling part.

The case may include a handle accommodation part which is opened toward the front part and in which the door handle is accommodated, and a slider accommodation part configured to communicate with the handle accommodation part, open toward the side part, and extend to a rear surface of the door, to accommodate the push slider.

A handle rotation shaft configured to protrude to both sides to serve as a rotation shaft of the door handle may be formed on the rear surface of the door handle, and the handle rotation shaft may be rotatably coupled to the case.

A pressing protrusion which protrudes to be in contact with the push slider when the door handle is rotated may be formed on a rear surface of the door handle above the handle rotation shaft.

A pressing part configured to rotate the door handle by a user pressing the door handle may be formed on a front surface of the door handle above the handle rotation shaft.

The push slider may include a horizontal part accommodated in the case and in contact with the upper rear end of the door handle, and a vertical part extending vertically rearward from an end portion of the horizontal part and in contact with the cabinet through a rear surface of the door.

The case may be provided with a spring configured to support the horizontal part from the rear, and the spring may be compressed when the push slider moves rearward.

A spring mounting part protruding through the spring may be formed in the case, and a guide hole which is opened to pass through the spring mounting part and guides the movement of the push slider in the front and rear direction may be formed in the horizontal part.

In a state where the door handle is not manipulated, the push slider may be supported by the spring, and thus the rear end of the push slider may maintain a state of being spaced apart from the cabinet.

A distance from the handle rotation shaft to a lower end of the door handle may be formed to be longer than a distance from the handle rotation shaft to an upper end of the door handle.

The storage space may be partitioned on both sides in the left and right direction by a barrier, the door may be configured to open and close each space partitioned on both sides by rotation, and the door opening device may be disposed such that the push slider protrudes toward the barrier.

The door opening devices may be respectively disposed at adjacent end portions of the doors on both sides in the left and right direction and are disposed at the same height as each other.

DETAILED DESCRIPTION OF THE EMBODIMENTS

Figure 1:
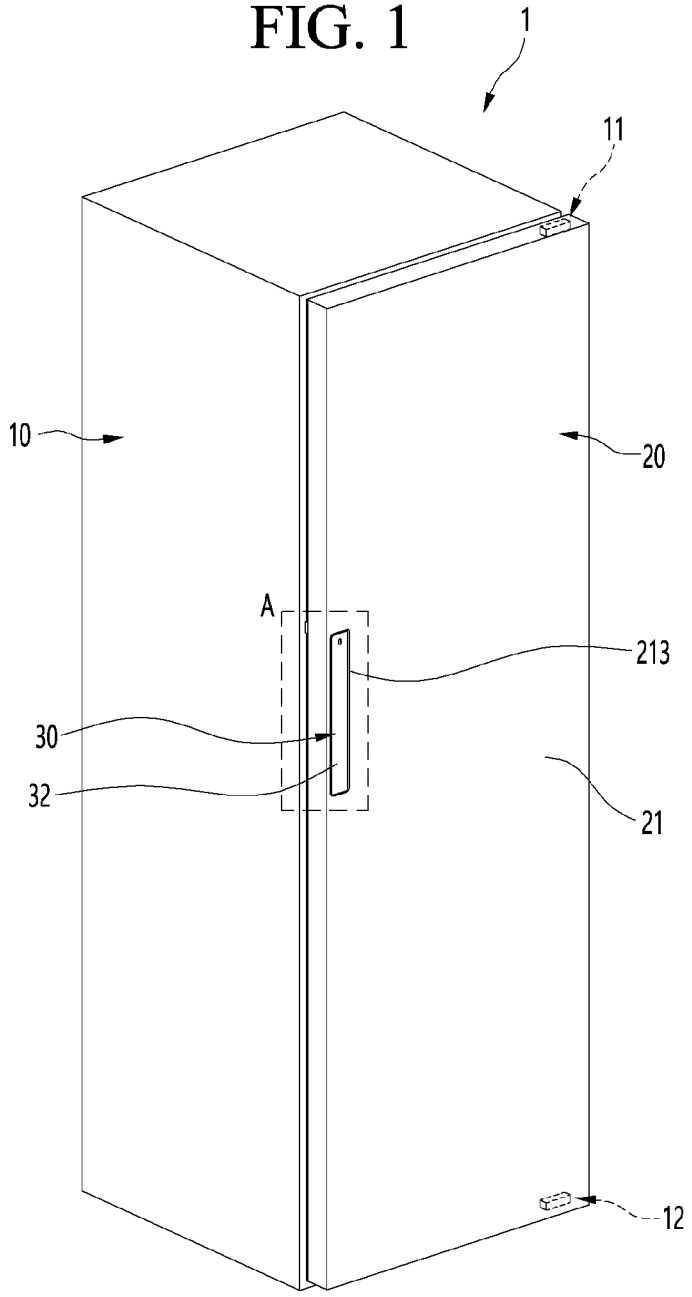
FIG. 1 is a perspective view illustrating a refrigerator according to an embodiment of the present disclosure.

Hereinafter, some embodiments of the present disclosure will be described in detail with reference to exemplary drawings. In adding reference numerals to the components of each drawing, it should be noted that the same components are given the same reference numerals as much as possible even though they are indicated on different drawings. In addition, in describing an embodiment of the present disclosure, a detailed description of a related known configuration or a function thereof will be omitted if it is determined that it is obvious to those skilled in the art.

In addition, the embodiment of the present disclosure will be described, as an example, a shape of a refrigerator configured with a single door for convenience of explanation and understanding, and it is clarified in advance that the present disclosure is applicable to all refrigerators provided with a door.

Before the description, the direction is defined. In FIG. 1, the direction in which the door 20 is disposed with respect to the cabinet 10 may be referred to as a front direction, the direction in which the cabinet 10 is disposed based on the door 20 may be referred to as a rear direction, and the direction facing the floor surface on which the cabinet 10 is installed may be referred to as a lower direction, and a direction away from the floor surface on which the cabinet 10 is installed may be referred to as an upper direction.

FIG. 1 is a perspective view illustrating a refrigerator according to an embodiment of the present disclosure.

As illustrated in the drawing, the refrigerator 1 according to an embodiment of the present disclosure may include a cabinet 10 forming a storage space, and a door 20 for opening and closing the opened front surface of the cabinet 10.

The door 20 may shield the storage space in a closed state and may form an outer appearance of the front surface of the refrigerator 1. Although a structure for shielding one storage space with one door 20 is disclosed in the embodiment of the present disclosure, a plurality of the storage spaces are provided, and a plurality of the doors 20 may also be provided.

Meanwhile, hinge devices 11 and 12 may be mounted on the upper end and lower end of the door 20. The hinge devices 11 and 12 may be fixedly mounted to the cabinet 10, and the door 20 may be rotatably mounted to the cabinet 10. The hinge devices 11 and 12 may be provided at one end (right end in FIG. 1) of both sides of the door 20 in the left and right direction.

In addition, a door opening device 30 including a door handle 32 for opening and closing the door 20 may be provided on the front surface of the door 20. The door handle 32 is provided on the front surface of the door 20 and may be positioned at an appropriate height so that the user can pull or push the door handle with hand. For example, the door handle 32 may be located at the middle of the height of the door 20 in the vertical direction or a height slightly higher than the middle. In addition, the door handle 32 may be located at one end of both ends of the door 20 in the left and right direction, which is far from the hinge devices 11 and 12. Accordingly, the door 20 can be rotated by pulling or pushing the door handle 32, and the cabinet 10 can be opened and closed.

Meanwhile, the door handle 32 is mounted on the front surface of the door 20 and may be disposed on the door plate 21 forming the front surface of the door 20 in a state of being mounted. The door handle 32 may be located inside the plate opening 213 (or front opening) of the door plate 21 and may be formed in a shape corresponding to the plate opening 213. In addition, the door handle 32 may be located on the same plane as the front surface of the door 20, that is, the door plate 21 in a state where the user does not manipulate the door handle. Accordingly, the door handle 32 may form a portion of the front surface of the door 20. In addition, the door handle 32 may shield the plate opening 21.

Hereinafter, the structure of the door 20 will be described in more detail with reference to the drawings.

Figure 2:
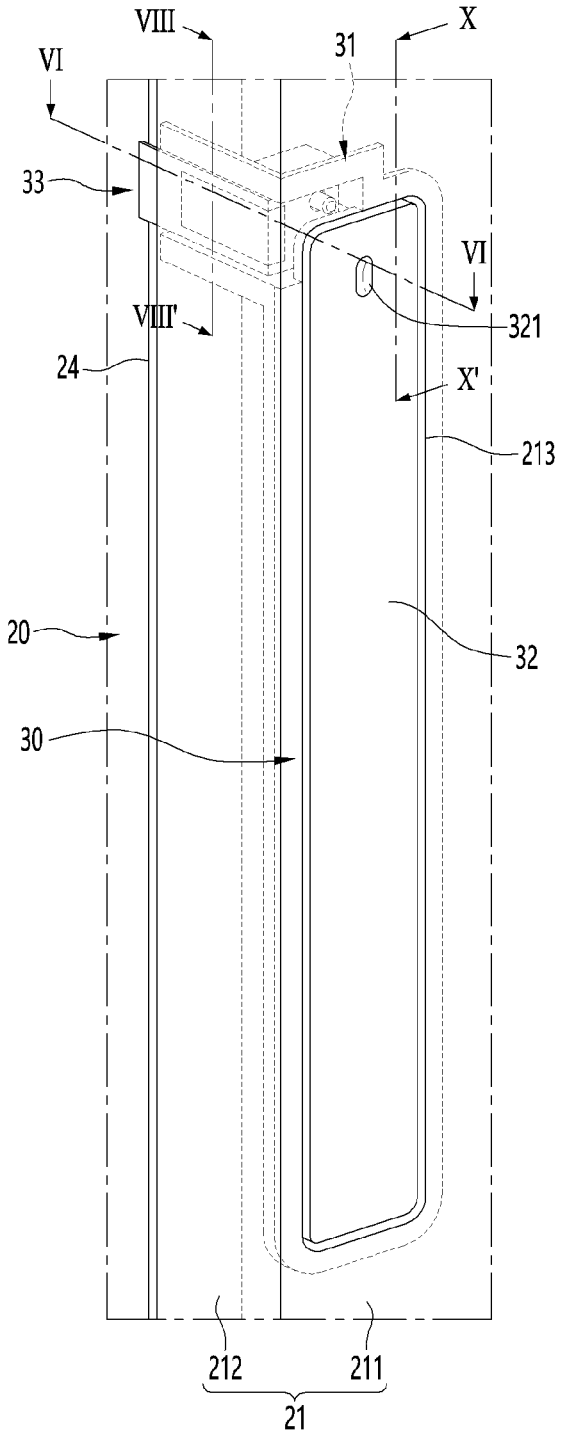
FIG. 2 is an enlarged view illustrating part A of FIG. 1.
Figure 3:
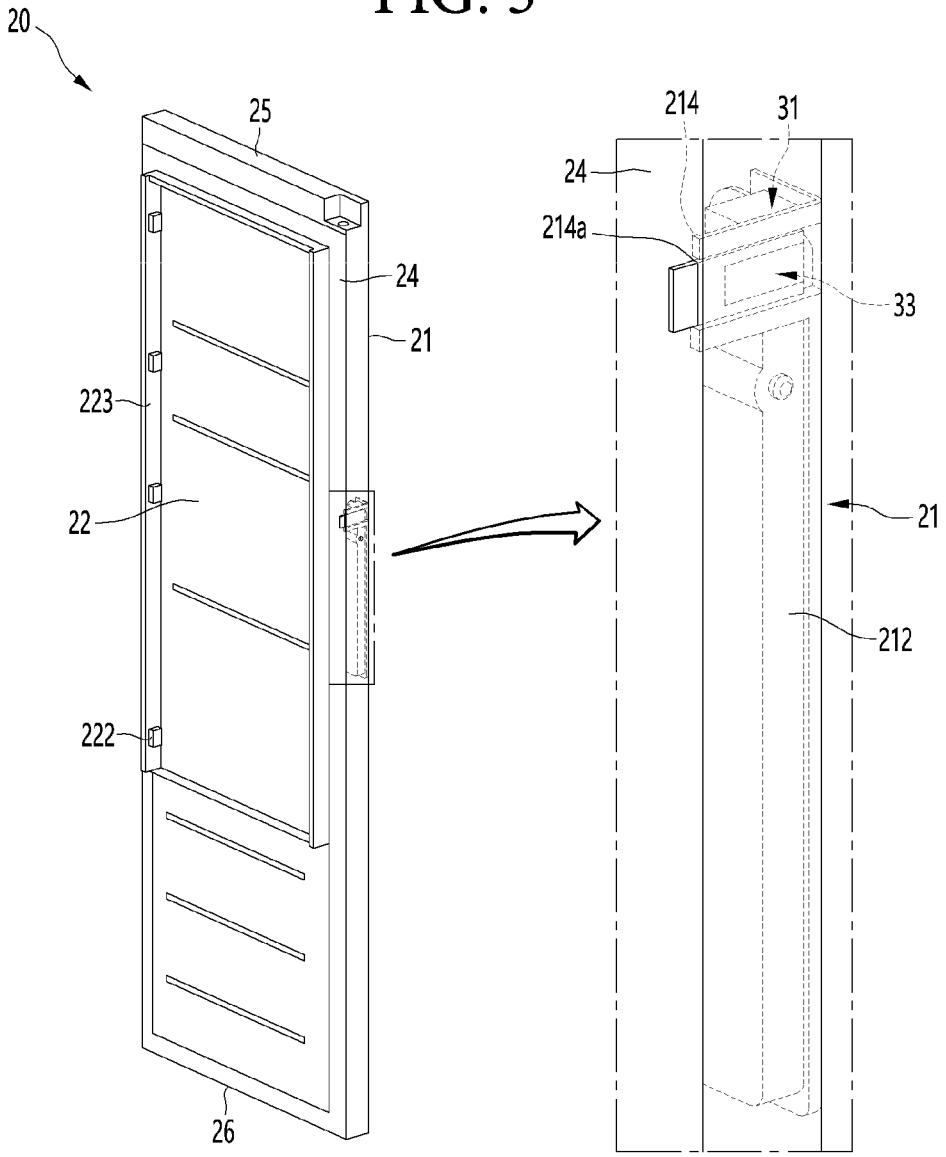
FIG. 3 is a perspective view illustrating a door according to an embodiment of the present disclosure as viewed from the rear.

FIG. 2 is an enlarged view illustrating part A of FIG. 1, and FIG. 3 is a perspective view illustrating a door according to an embodiment of the present disclosure as viewed from the rear.

As illustrated in the drawing, the door 20 may include a door plate 21 forming an outer appearance of the front surface and a door liner 22 forming a rear surface. In addition, the door 20 may further include cap decorations 25 and 26 forming the upper and lower surfaces of the door 20. In addition, an insulation material (23 in FIG. 6) may be filled in the inner space in which the door plate 21, the door liner 22, and the cap decorations 25 and 26 are coupled. In addition, the insulation material 23 may be formed by injecting a foaming liquid.

The door plate 21 may be made of a metal material and may be bent to form both side surfaces of the door 20 in the left and right direction as well as the front surface of the door 20. In other words, the door plate 21 may include a front part 211 that forms the front surface of the door 20, and side parts 212 that are bent at side ends of the front part 211 and forms side surfaces of the door 20. Of course, the door 20 may be made of a material other than a metal material, and the front and side surfaces of the door 20 may be configured to be coupled to each other in each configuration.

In addition, both ends of the door plate 21 may be coupled to the door liner 22. The door liner 22 may be made of a plastic material, and a mounting part 222 on which an accommodation member is mounted on the rear surface of the door 20 and a door dike 223 protruding along the circumference of the rear surface of the door 20 can be formed.

A gasket 24 may be provided around the rear surface of the door liner 22. The gasket 24 may come in contact with the front surface of the cabinet 10 in a state where the door 20 is closed, thereby sealing the space between the door 20 and the cabinet 10. The gasket 24 may be formed along the outer end of the rear surface of the door 20 and may be formed along the circumference of the door dike 223.

In addition, a magnet 243 (in FIG. 6) may be embedded in the gasket 24. Accordingly, the gasket 24 can maintain a state of being in close contact with the front surface of the cabinet 10 made of steel by the magnet 243 in a state where the door 20 is closed, so that the storage space can be made more airtight.

Cap decorations 25 and 26 may be mounted on the upper and lower ends of the door plate 21 and the door liner 22, respectively. The cap decorations 25 and 26 may form a closed space inside the door 20 by connecting the door plate 21 and the door liner 22. In addition, the cap decorations 25 and 26 may form an upper surface and a lower surface of the door 20, respectively. In addition, the hinge shafts of the hinge devices 11 and 12 may be inserted into one ends of the cap decorations 25 and 26.

Meanwhile, the door 20 may be provided with a door opening device 30 for opening and closing the door 20. The door opening device 30 may include a door handle 32 manipulated by the user to open the door 20 and a push slider 33 protruding toward the rear of the door 20 in conjunction with the manipulation of the door handle 32 and pushing the cabinet 10. In addition, the door opening device 30 may further include a case 31 which is disposed inside the door 20 and in which an accommodation space 310 for accommodating the door handle 32 and the push slider 33 is formed.

The case 31 may be in close contact with the front part 211 and the side part 212 of the door plate 21, so that the insulation material 23 inside the door 20 can be prevented from entering inside the accommodation space 310. In addition, the case 31 may be formed to provide a space in which the rotational operation of the door handle 32 and the linear reciprocating movement of the push slider 33 are possible.

Meanwhile, the door handle 32 may be formed to correspond to the size of the plate opening 213 and may be disposed inside the plate opening 213 of the door plate 21 in a state where a user does not manipulate the door handle 32. In addition, the front surface of the door handle 32 may form the same plane as the front surface of the door plate 21. Accordingly, the front surface of the door 20 may be formed in a planar shape with no protruding portions as a whole, and thus the outer appearance of the door 20, that is, the outer appearance of the front surface of the refrigerator 1 may be configured more simply and neatly.

In addition, the door handle 32 may be formed of the same metal material as the plate opening 213 so that the entire outer appearance of the front surface of the door 20 has a sense of unity. Of course, the door handle 32 may be made of a material having the same or similar texture to the door plate 21 instead of a metal material.

Hereinafter, the door opening device 30 and the coupling structure of the door opening device 30 will be described in more detail with reference to the drawings.

Figure 4:
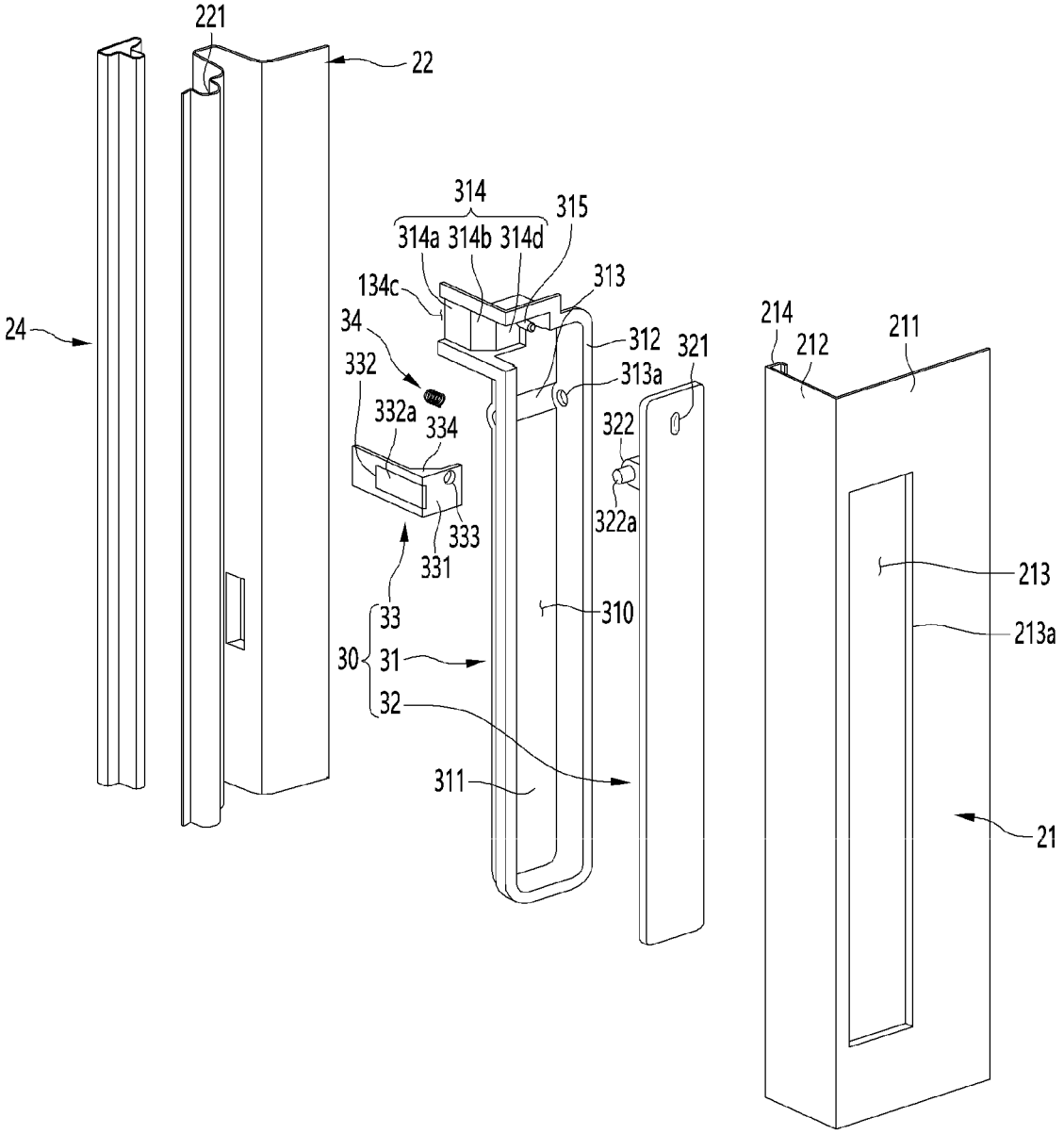
FIG. 4 is an exploded perspective view illustrating the mounting structure of the door opening device according to the embodiment of the present disclosure as viewed from the front.
Figure 5:
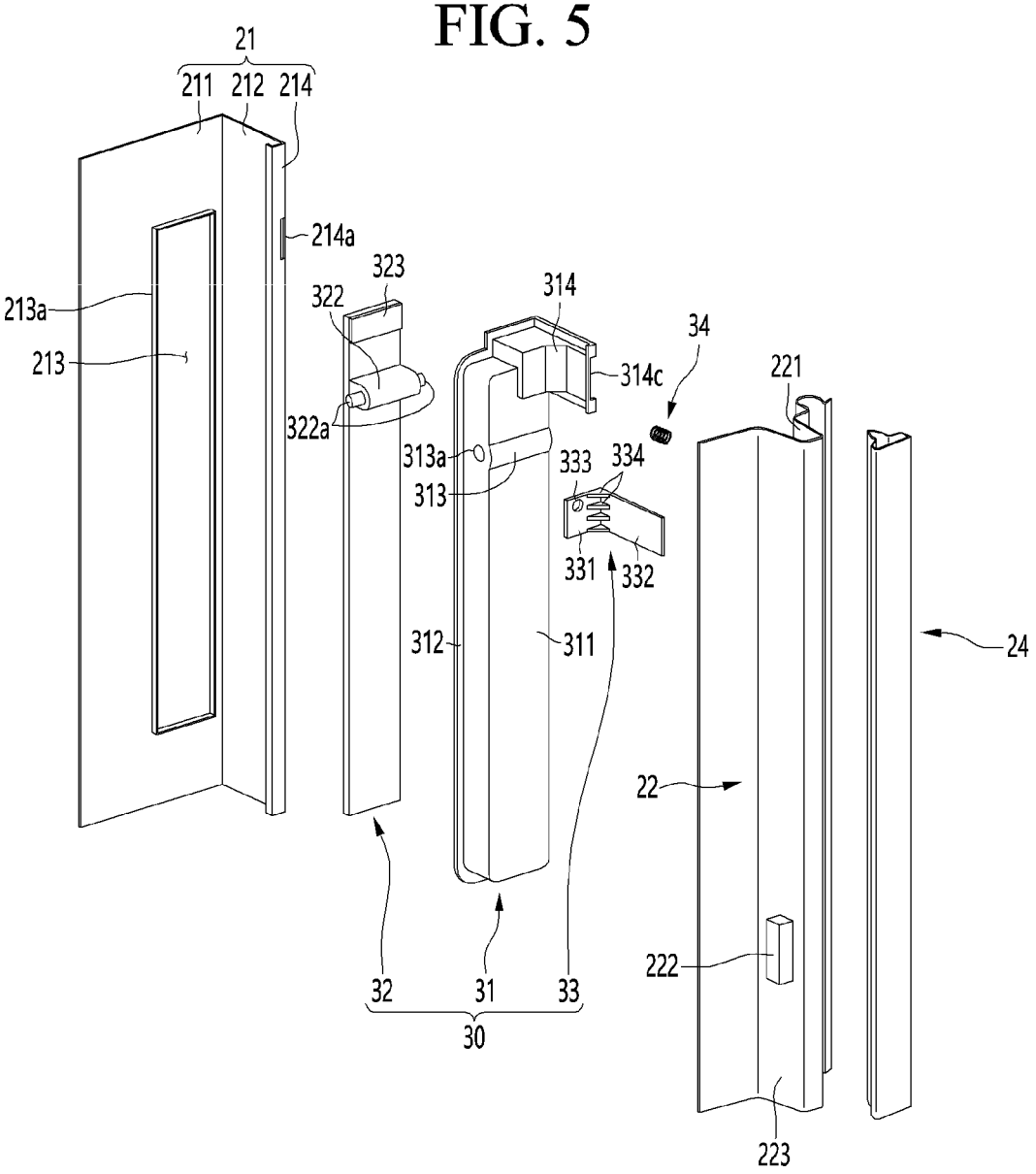
FIG. 5 is an exploded perspective view illustrating the mounting structure of the door opening device as viewed from the rear.
Figure 6:
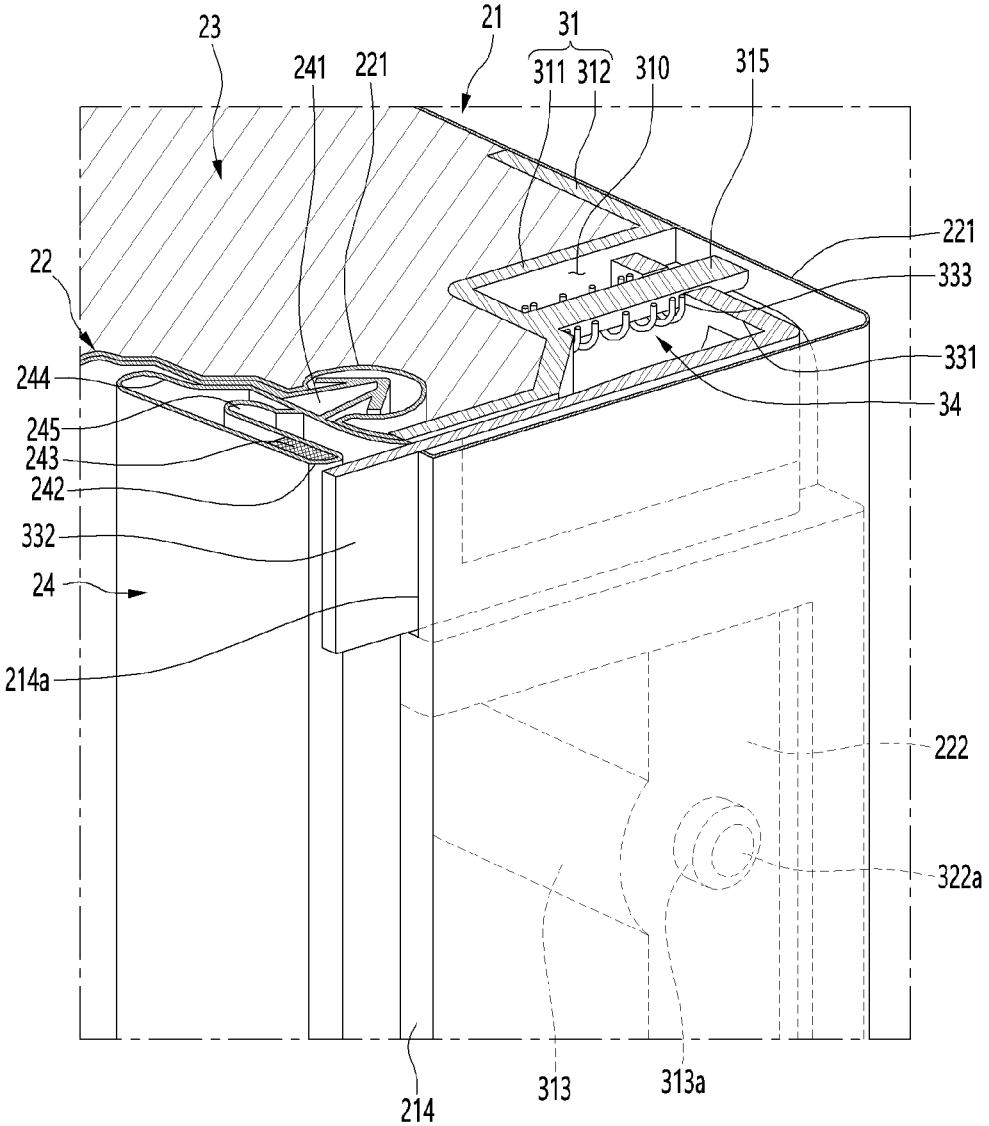
FIG. 6 is a cutaway perspective view taken along line VI-VI' of FIG. 3.
Figure 7:
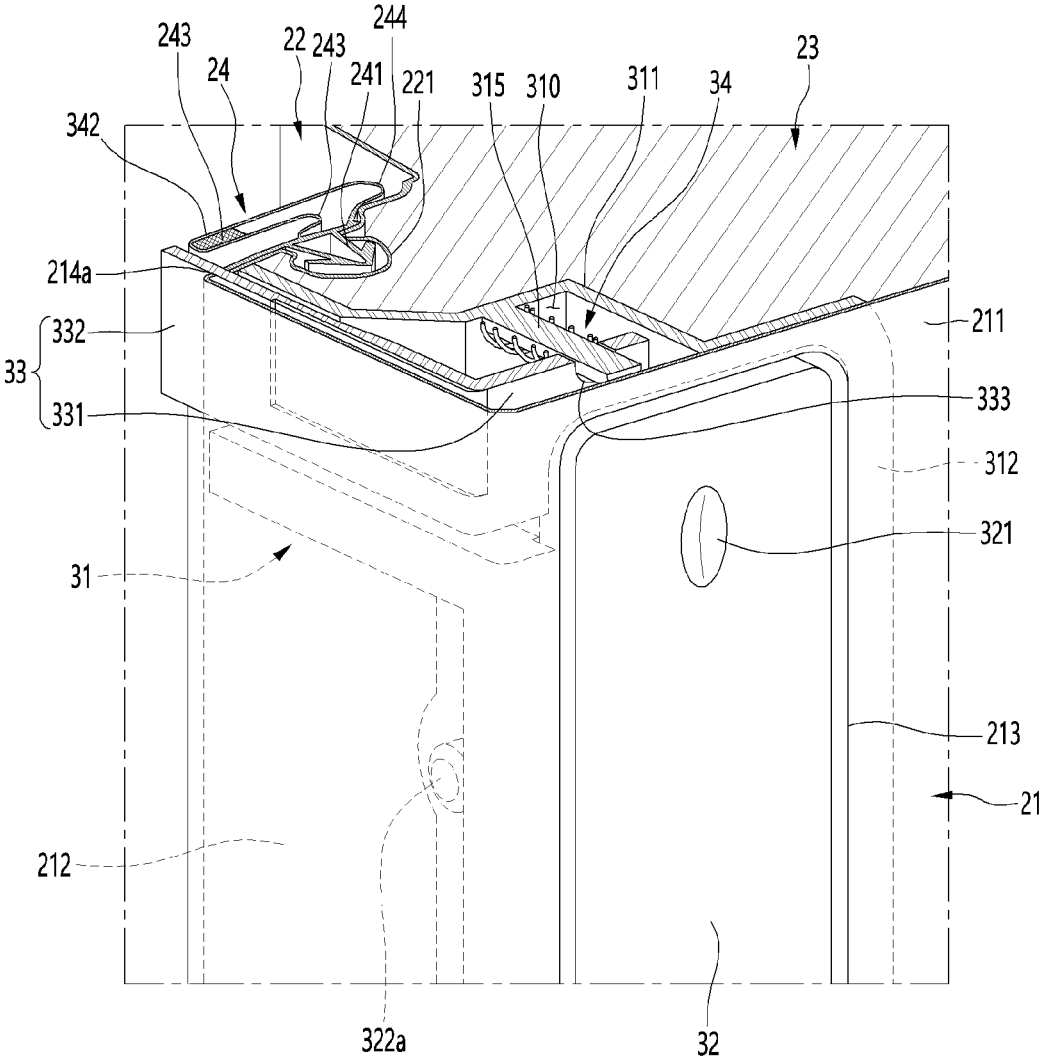
FIG. 7 is a view illustrating FIG. 6 as viewed from the front.
Figure 8:
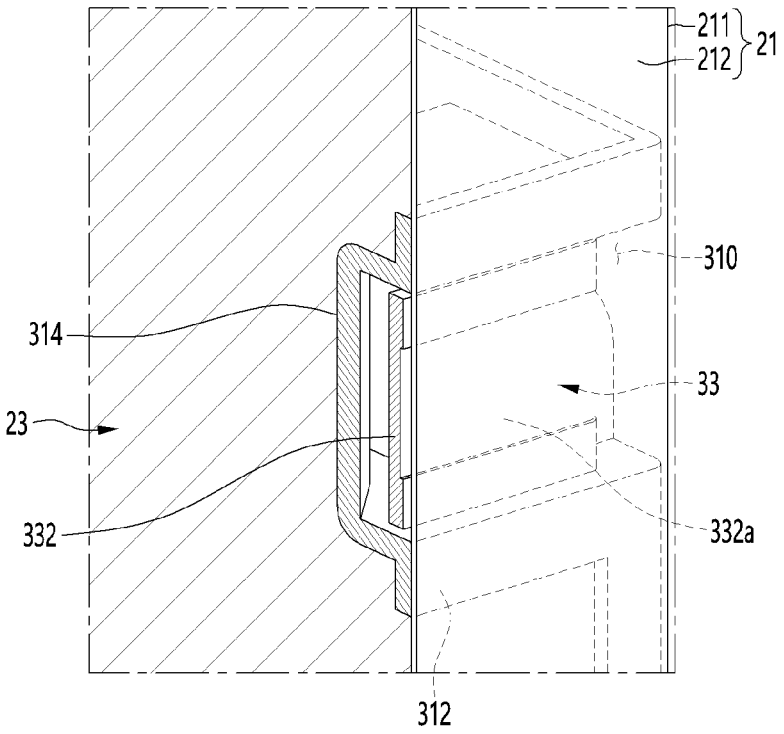
FIG. 8 is a cutaway perspective view taken along line VIII-VIII' of FIG. 3.

FIG. 4 is an exploded perspective view illustrating the mounting structure of the door opening device according to the embodiment of the present disclosure as viewed from the front, FIG. 5 is an exploded perspective view illustrating the mounting structure of the door opening device as viewed from the rear. FIG. 6 is a cutaway perspective view taken along line VI-VI' of FIG. 3, FIG. 7 is a view illustrating FIG. 6 as viewed from the front, and FIG. 8 is a cutaway perspective view taken along line VIII-VIII' of FIG. 3.

As illustrated in the drawing, the door opening device 30 may include a door handle 32 and a push slider 33. In addition, the door opening device 30 may further include the case 31.

The case 31 may be made of a plastic material and may form a recessed accommodation space 310. The accommodation space 310 may include a handle accommodation part 311 accommodating the door handle 32 and a slider accommodation part 314 accommodating the push slider 33.

In addition, a border 312 may be formed along the opened circumference of the accommodation space 310. The border 312 may be in contact with the rear surface of the door plate 21. An adhesive may be applied 새 the border 312, and the border 312 may be fixedly mounted to the inner surface of the door plate 21 to shield the accommodation space 310.

The handle accommodation part 311 may be formed to have a shape corresponding to the shape of the door handle 32 to accommodate the door handle 32. In addition, the handle accommodation part 311 may open forward, and the opened front surface of the handle accommodation part 311 may communicate with the plate opening 213.

In detail, a bent part 213*a* bent toward the inside of the door 20 is formed along the circumference of the plate opening 213, and the bent part 213*a* may be inserted into an opened front surface of the handle accommodation part 311 and be in contact with the circumference of the inner surface of the handle accommodation part 311. Accordingly, the door handle 32 may be accommodated in the handle accommodation part 311 and located inside the plate opening 213.

Meanwhile, a mounting groove 313 in which the handle mounting part 322 of the door handle 32 is disposed may be formed inside the handle accommodation part 311. In addition, shaft insertion holes 313*a* into which the handle rotation shaft 322*a* is inserted may be formed on both sides of the handle mounting part 322. In other words, the handle mounting part 322 may be formed on the rear surface of the handle accommodation part 311, and the shaft insertion hole 313*a* may be formed on both side surfaces of the handle mounting part 322 in the left and right direction. The mounting groove 313 and the shaft insertion hole 313*a* may be formed on the handle accommodation part 311.

In addition, the slider accommodation part 314 may communicate with one side of the handle accommodation part 311. For example, the slider accommodation part 314 may be formed at an upper end of the handle accommodation part 311. In addition, at least a portion of the slider accommodation part 314 may extend rearward. In this case, the slider accommodation part 314 may extend to the rear surface of the door 20.

The slider accommodation part 314 may be opened laterally, and the opened side surface may be in contact with the side part 212 of the door plate. In addition, an opening 314*c* may be formed at the rear end of the slider accommodation part 314, and when the push slider 33 is moved in the rear direction, the rear end of the push slider 33 may be configured to protrude through the opening 314*c* of the rear end of the slider accommodation part 314.

In detail, a plate coupling part 214 that is bent inwardly and forms a circumference of the rear surface of the door 20 may be formed at the extended end portion of the side part 212 of the door plate 21. In addition, an end portion of the plate coupling part 214 may be coupled to an outer end of the door liner 22.

In addition, a slider outlet 214*a* (or rear opening) through which the push slider 33 enters and exits may be formed in the plate coupling part 214. In addition, the opened rear end of the slider accommodation part 314 may communicate with the slider outlet 214*a*. Therefore, when the push slider 33 is moved in the rear direction, the end portion of the push slider 33 may protrude in the rear direction through the opening 314*a* of the slider accommodation part 314 and the slider outlet 214*a*.

Meanwhile, the inner surface of the slider accommodation part 314 may include a horizontal surface 314*d* and a vertical surface 314*a*. In addition, the slide accommodation part 314 may further include an inclined surface 314*b* between the horizontal surface 314*d* and the vertical surface 314*a*. Accordingly, the bent push slider 33 may be accommodated in an operable state inside the slider accommodation part 314. The horizontal surface 314*d* may form the same plane as the rear surface of the handle accommodation part 311 or a plane parallel to the rear surface thereof and may accommodate the horizontal part 331 of the push slider 33.

In addition, a spring mounting part 315 on which a spring is mounted may be formed on the horizontal surface 314*d*. The spring mounting part 315 may be formed in a protrusion shape penetrating the coil-shaped spring 34. Accordingly, the spring 34 may maintain a state of being mounted without being detached from the inside of the case 31.

The spring 34 may support the rear surface of the horizontal part 331 and may be compressed according to the movement of the push slider 33. In addition, the push slider 33 may be returned to the initial position thereof by the elastic force of the spring 34.

The spring mounting part 315 may extend to pass through the guide hole 333 of the horizontal part 331, and the push slider 33 may be guided to maintain the position when moving in the front and rear direction by a guide inside the slider accommodation part 314, the spring mounting part 315, and the guide hole 333.

The inclined surface 314*b* may extend from the horizontal surface 314*d* to be inclined toward the rear of the slider accommodation part 314. Due to the inclined surface 314*b*, the push slider 33 may be guided toward the vertical surface 314*a* without being caught in the movement of the push slider 33 in the front and rear direction.

The vertical surface 314*a* may extend rearward from the end portion of the inclined surface 314*b* and may be formed in parallel with the side part 212 or formed perpendicular to the vertical surface 314*a*. The extended rear end of the vertical surface 314*a* forms the rear end of the slider accommodation part 314. The vertical part 332 of the push slider 33 is formed in the inner space of the inclined surface 314*b* and the vertical surface 314*a* and can be moved in the front and rear direction.

The door handle 32 may be rotatably mounted on the inside of the handle accommodation part 311, and in a mounted state, the opened front surface of the handle accommodation part 311 and the plate opening 213 may be shielded.

In detail, the door handle 32 may be formed in a plate shape and may be formed to correspond to the shape of the plate opening 213. In addition, the handle mounting part 322 protruding in the rear direction may be formed on the rear surface of the door handle 32. The handle mounting part 322 allows the door handle 32 to be fixedly mounted to the case 31 and may protrude to be located inside the mounting groove 313. In addition, the inner surface of the mounting groove 313 in contact with the end portion of the handle mounting part 322 and the end portion of the handle mounting part 322 is formed to be rounded and thus may be configured to stably support the door handle 32 when the door handle 32 rotates.

In addition, the handle rotation shaft 322*a* protruding laterally may protrude from both ends of the handle mounting part 322 in the left and right direction. The handle rotation shaft 322*a* serves as a rotation shaft of the door handle 32 and may protrude from the handle mounting part 322 and be inserted into and coupled to the shaft insertion hole 313*a* of the case 31.

Accordingly, the door handle 32 may be rotated in a state of being accommodated in the case 31. In this case, the handle rotation shaft 322*a* and the handle mounting part 322 may be positioned to be biased toward the upper end of the door 20 based on the length of the door handle 32 in the vertical direction. For example, the distance from the upper end of the door handle 32 to the handle rotation shaft 322*a* and the distance from the lower end of the door handle 32 to the handle rotation shaft 322*a* may have a ratio of about 1:7 to 8. As the handle rotation shaft 322*a* is disposed on the door handle 32 at the same distance ratio as above, the door handle 32 protrudes to a position convenient for a user to grip during manipulation and simultaneously pushes the slider 33 with sufficient force, and thus the door 20 may be easily opened.

Due to such a structure, when the door handle 32 is rotated by pressing the upper end of the door 20, the lower part of the door handle 32 can protrude more outward, making it easy for the user to grip and pull the door handle by hand. In addition, when the lower part of the door handle 32 is gripped and pulled, it may be possible for the upper end of the door handle 32 to push the upper end of the push slider 33 with greater force due to the principle of a lever.

To this end, a pressing part 321 for inducing a user's pressing manipulation may be formed on the upper end of the front surface of the door handle 32. The pressing part 321 may be formed above the handle rotation shaft 322*a* to indicate a position that the user presses with a finger. The pressing part 321 may be protruded or recessed and may be formed to be displayed through printing or surface processing.

In addition, a pressing protrusion 323 protruding in the rear direction may be formed on the upper end of the rear surface of the door handle 32. The pressing protrusion 323 may be formed at a height corresponding to the pressing part 321 and may protrude in the rear direction to contact the push slider 33. Accordingly, when the user presses the pressing part 321, the pressing protrusion 323 may press the front surface of the horizontal part 331 of the push slider 33.

In a state where the door handle 32 is not manipulated, the pressing protrusion 323 may protrude so as to be in contact with the front surface of the horizontal part 331 of the push slider 33. Accordingly, the movement of the push slider 33 in the front direction and rotation of the door handle 32 may be made immediately at the moment the user presses the pressing part 321 for manipulating the door handle 32.

The push slider 33 may be made of a plastic material and may be formed in a bent plate shape to be accommodated inside the slider accommodation part 314. The push slider 33 may include a horizontal part 331 and a vertical part 332.

The horizontal part 331 may have a surface parallel to the door handle 32 and the door plate 21 and may be disposed in a region corresponding to the horizontal surface 314*d* of the slider accommodation part 314. In addition, the front surface of the horizontal part 331 may be in contact with the pressing protrusion 323 of the door handle 32. In addition, a guide hole 333 through which the spring mounting part 315 passes may be formed in the horizontal part 331.

The horizontal part 331 may be supported at the rear by the spring 34 in a state of being penetrated by the spring mounting part 315. Accordingly, the front surface of the horizontal part 331 may be in a state of being in contact with the pressing protrusion 323. In addition, in this state, the end portion of the vertical part 332 is in a state of being located in the front direction, and the rear end of the vertical part 332 is maintained in a state of being spaced apart from the cabinet 10.

The vertical part 332 may extend vertically rearward from the end portion of the spring mounting part 315. The vertical part 332 may have a size corresponding to the inner surface of the slider accommodation part 314, and movement may be guided by the inclined surface and the vertical surface 314*a* during the forward and rearward movement.

In the vertical part 332, in a state where the push slider 33 is moved most forward, the rear end of the vertical part 332 may be formed so as to be positioned at a position corresponds to the opening 314*c* of the case 31 and the slider outlet 214*a* or a position that is more protruded to the rear.

In addition, the rear end of the vertical part 332 may be positioned more forward than the rear surface of the gasket 24 in a state where the push slider 33 may be moved forward and may be spaced apart from the cabinet 10 and thus may maintain a state where the door 20 is closed.

In addition, when the push slider 33 moves in the front direction by manipulating the door handle 32, the rear end of the vertical part 332 and the cabinet 10 come into contact with each other, and the cabinet 10 is pushed and thus the door 20 may be opened more easily.

A vertical part groove 332*a* may be formed on an outer surface of the vertical part 332. The vertical part groove 332*a* may be recessed in the center of the vertical part 332 and may be recessed along the extending direction of the vertical part 332. Accordingly, only both ends of the outer surface of the vertical part 332 can be in contact with the side part 212, and friction with the door plate 21 can be minimized while the push slider 33 is moving. In addition, since the outer end of the vertical part 332 has a stepped shape by the vertical part groove 332*a*, it is possible to prevent the vertical part 332 from being deformed even by repeated shocks and loads.

Meanwhile, the end portions of the horizontal part 331 and the vertical part 332 may be vertically connected to each other. In addition, a reinforcing part 334 may be formed between the horizontal part 331 and the vertical part 332. The reinforcing part 334 may connect between the horizontal part 331 and the vertical part 332, and a plurality of reinforcing parts are connected at regular intervals so that even if a load is applied to the horizontal part 331 and the vertical part 332, it is possible to prevent the push slider 33 from being deformed and damaged.

A gasket mounting part 221 on which the gasket 24 is mounted may be recessed in the door liner 22. A mounting protrusion part 241 that is inserted and fixed to the gasket mounting part 221 may be formed on the gasket 24. In addition, a magnet accommodation part 242 in which the magnet 243 is accommodated may be formed in the gasket 24. In addition, gasket connection parts 244 and 245 connecting the mounting protrusion part 241 and the magnet accommodation part 242 may be formed. The gasket 24 may extend in a state where the magnet accommodation part 242 is in close contact with the cabinet 10 due to the structure of the gasket connection parts 244 and 245. In addition, the gasket 24 may be made of an elastic material.

In addition, the outer end of the door liner 22 may be coupled to the plate coupling part 214 of the door plate 21. In a state where the gasket 24 is mounted on the rear surface of the door 20, the plate coupling part 214 and the slider outlet 214*a* may be exposed to the outside of the gasket 24. Accordingly, the push slider 33 may be moved in the front and rear direction in the outer region of the gasket 24 and may protrude in the rear direction. Accordingly, the push slider 33 can open the door 20 by contacting the cabinet 10 without interfering with the gasket 24 in a state where the gasket 24 is kept airtight.

Hereinafter, a process of opening the door 20 of the refrigerator 1 according to an embodiment of the present disclosure having the above structure will be described in more detail with reference to the drawings.

Figure 9:
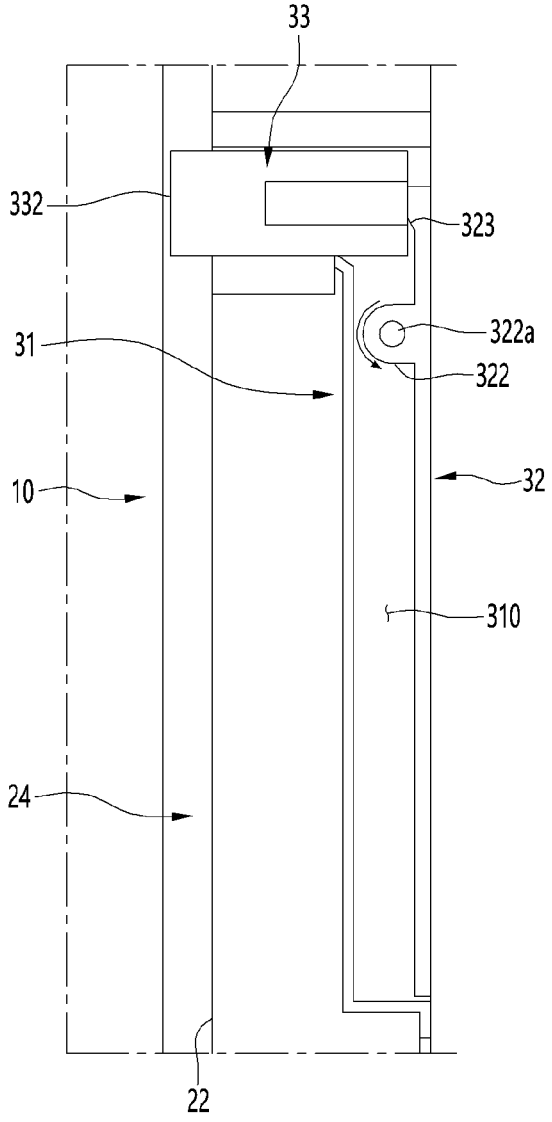
FIG. 9 is a view illustrating a state of the door opening device in a state where the door is closed.
Figure 10:
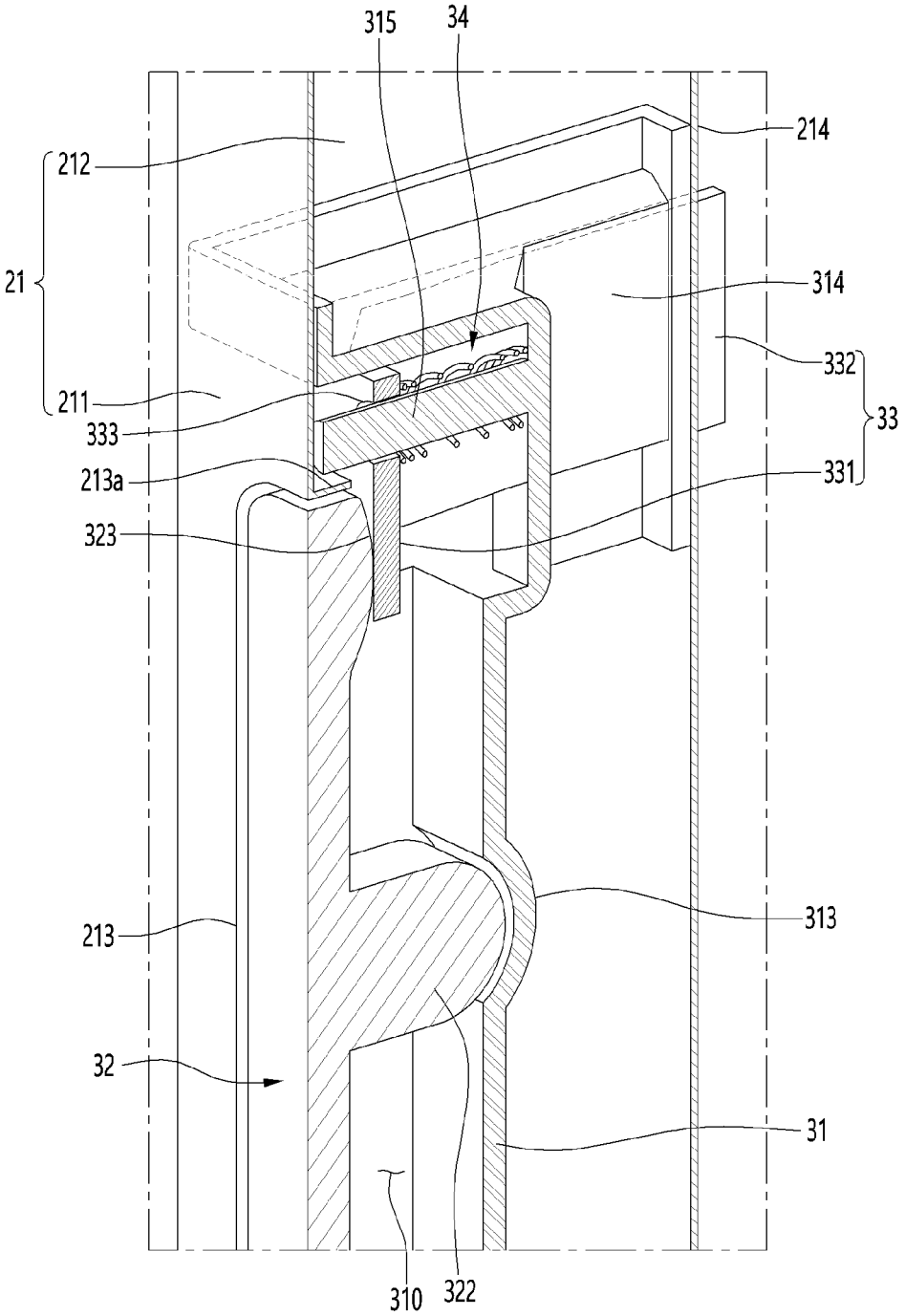
FIG. 10 is a cutaway perspective view illustrating an internal state of the door opening device in the state of FIG. 9.

FIG. 9 is a view illustrating a state of the door opening device in a state where the door is closed, and FIG. 10 is a cutaway perspective view illustrating an internal state of the door opening device in the state of FIG. 9 and illustrates a cross section taken along line X-X' of FIG. 2.

As illustrated in the drawing, in a state where the door handle 32 is not manipulated while the door 20 is closed, the door handle 32 shields the plate opening 213 and the push slider 33 may be in a state of being moved forward.

At this time, the horizontal part 331 is supported by the spring 34 and the push slider 33 is positioned at the frontmost position, so that the front surface of the horizontal part 331 and the pressing protrusion 323 may come into contact with each other.

Accordingly, the upper end of the door handle 32 is supported by the push slider 33, and the handle rotation shaft 322*a* of the door handle 32 is positioned upward, so that the door handle 32 may be in a state disposed perpendicular to the ground by own weight thereof. In other words, the door handle 32 does not protrude or is not recessed to the outside in a state of shielding the inside of the plate opening 213, and the front surface of the door handle 32 is in a state of being positioned on the same plane as the front surface of the door plate 21.

In such a state, when the door 20 is viewed from the outside, the front surface of the door 20 can be seen in a flat state without a protruding part, and the door handle 32 and the door plate 21 have the same texture so that the door handle and the door plate can be made to have a sense of unity.

In addition, the push slider 33 is moved most forward, and the rear end of the push slider 33 may be positioned more forward than the rear surface of the gasket 24. In other words, the rear end of the push slider 33 protrudes through the rear surface of the door 20, but the rear end of the push slider can be maintained in a state of being slightly spaced apart from the front surface of the cabinet 10. Accordingly, in a state where the door handle 32 is not manipulated, the push slider 33 is prevented from interfering with the gasket 24 or the cabinet 10 and thus the push slider can prevent the closing of the door 20 from being obstructed.

Figure 11:
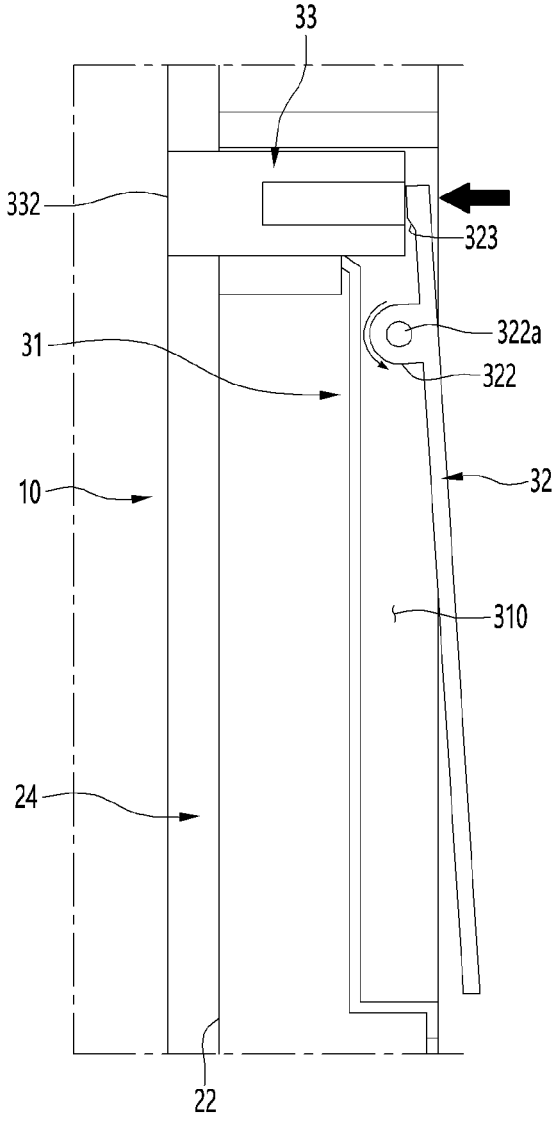
FIG. 11 is a view illustrating a state of the door opening device in a state where the door handle protrudes before the door is opened.
Figure 12:
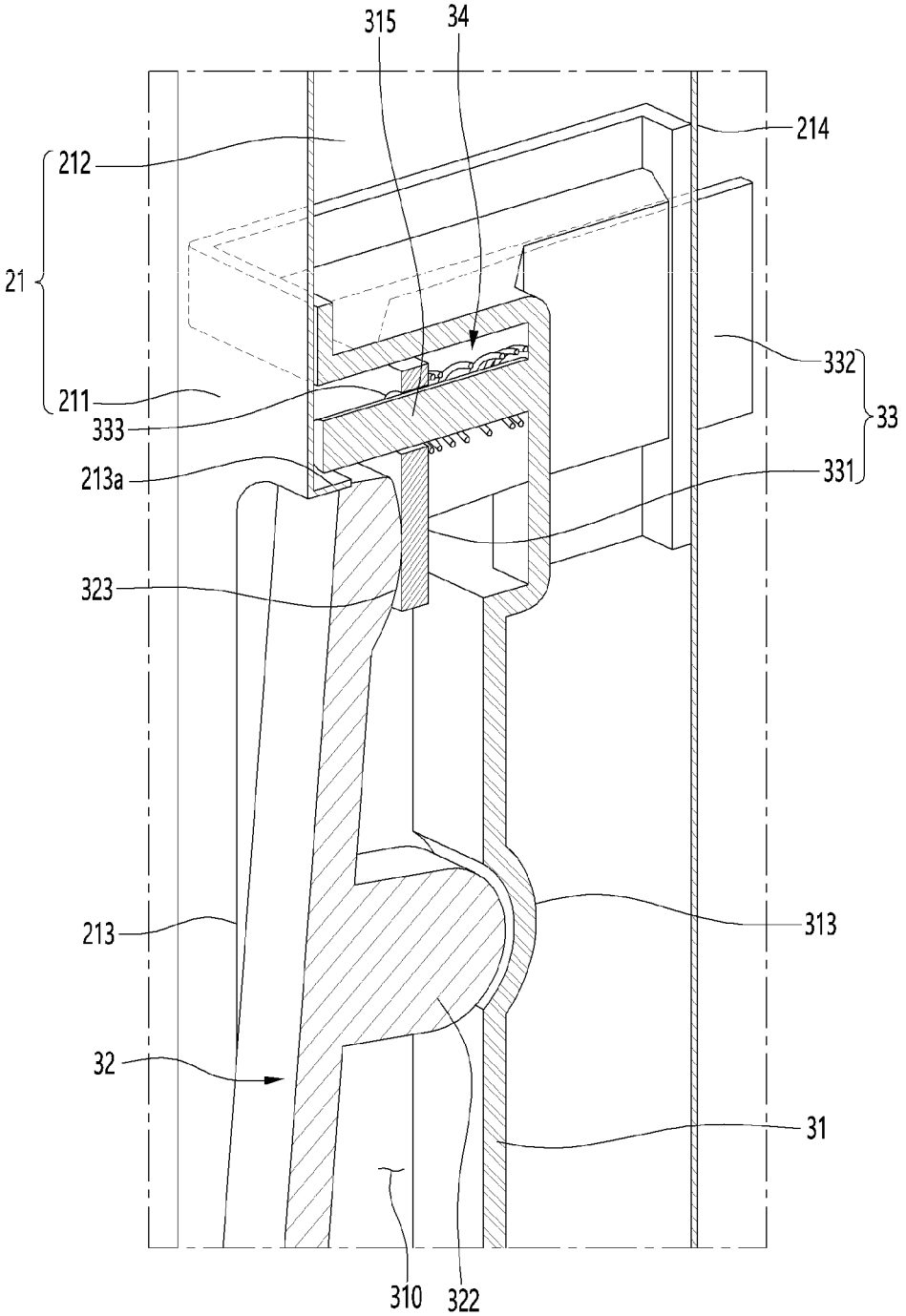
FIG. 12 is a cutaway perspective view illustrating an internal state of the door opening device in the state of FIG. 11.

FIG. 11 is a view illustrating a state of the door opening device in a state where the door handle protrudes before the door is opened, and FIG. 12 is a cutaway perspective view illustrating an internal state of the door opening device in the state of FIG. 11.

As illustrated in the drawing, in order to open the door 20 in a state where the door 20 is closed, the user operates the door handle 32. The user first presses the pressing part 321 of the upper end of the door handle 32 so that the door handle 32 can be manipulated.

When the pressing part 321 is pressed, the door handle 32 rotates in a counterclockwise direction based on the handle rotation shaft 322*a*, and the pressing protrusion 323 presses the horizontal part 331. Then, the push slider 33 moves in the rear direction.

When the push slider 33 moves in the rear direction, the spring 34 may be compressed, and the spring mounting part 315 passes through the guide hole 333. In addition, the vertical part 332 moves along the inclined surface 314*b* and the vertical surface 314*a*. Accordingly, the push slider 33 may be guided to move in the rear direction by the guide hole 333 and the slider accommodation part 314, and the rear end of the vertical part 332 protrudes in the rear direction and thus is in contact with the front surface of the cabinet 10.

Meanwhile, in a process in which the rear end of the push slider 33 is moved until the rear end of the push slider comes into contact with the cabinet 10, the door handle 32 may compress the spring 34 and may rotate smoothly until being in contact with the cabinet 10.

In addition, the lower end of the door handle 32 can protrude forwardly out of the plate opening 213. At this time, the lower part of the door handle 32 below the handle rotation shaft 322*a* is formed to be much longer than the upper part where the pressing part 321 is disposed, so that, only by the manipulation of the pressing part 321, the lower part of the door handle 32 may sufficiently protrude forward with respect to the front surface of the door 20.

Accordingly, the user pushes the pressing part 321 to protrude the lower part of the door handle 32 so that the user can easily grip the lower part of the door handle 32 by hand.

Figure 13:
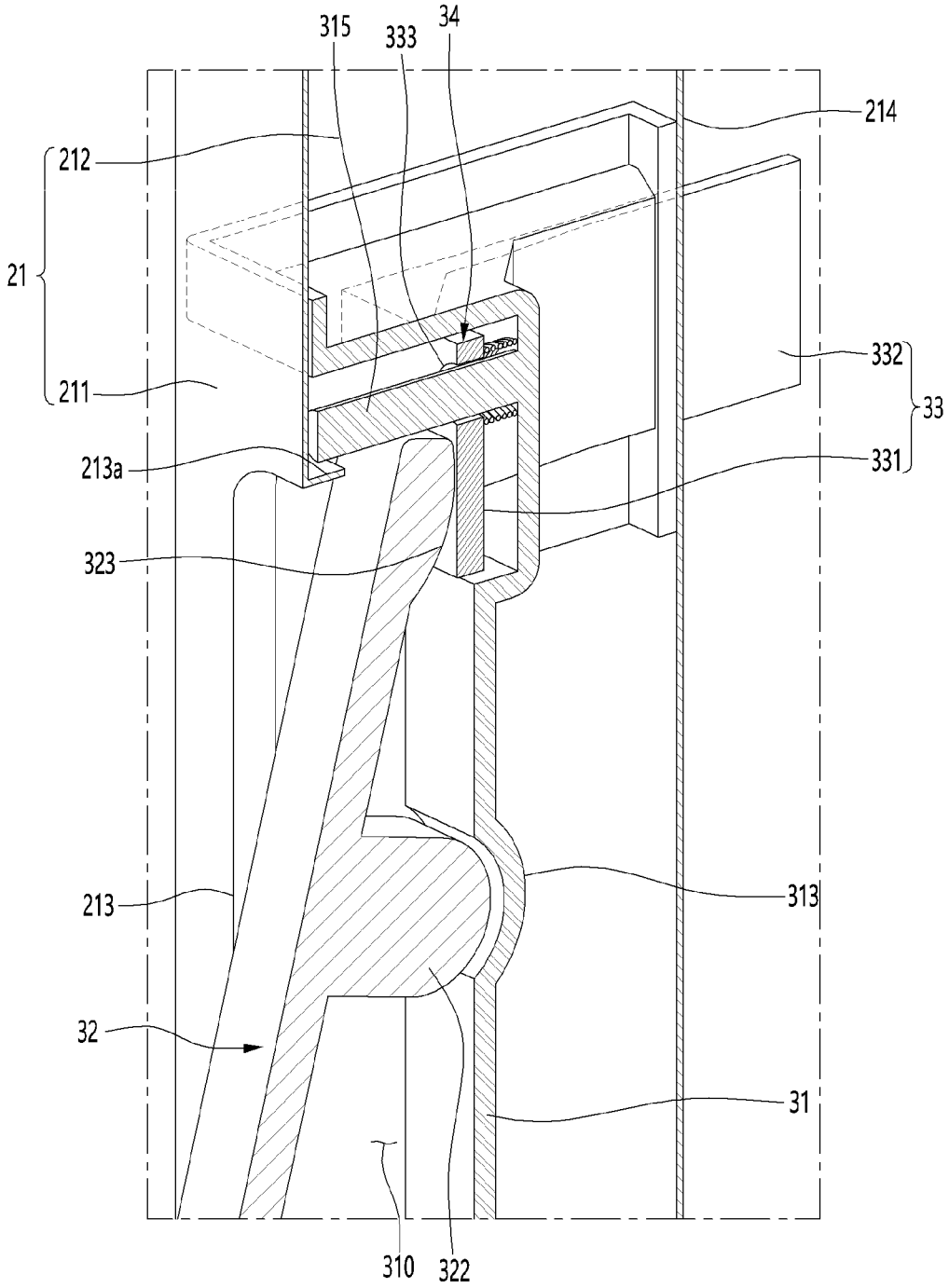
FIG. 13 is a view illustrating a state of the door opening device in a state where the door handle is pulled when the door is opened.
Figure 14:
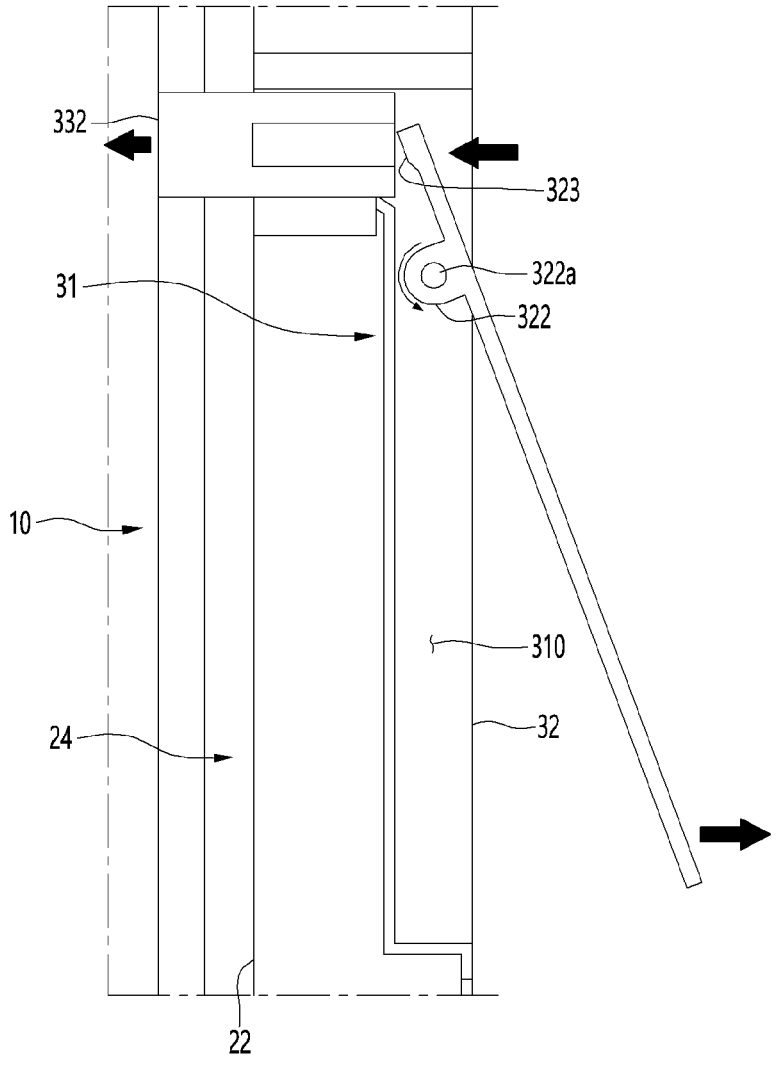
FIG. 14 is a cutaway perspective view illustrating an internal state of the door opening device in the state of FIG. 13.

FIG. 13 is a view illustrating a state of the door opening device in a state where the door handle is pulled when the door is opened, and FIG. 14 is a cutaway perspective view illustrating an internal state of the door opening device in the state of FIG. 13.

As illustrated in the drawing, in a state where the lower part of the door handle 32 protrudes from the front surface of the door 20, the user grips the lower part of the door handle 32, pulls the lower part of the door handle 32 in the front direction and thus can open the door 20.

When the lower part of the door handle 32 is gripped and pulled in the front direction, the door handle 32 is further rotated counterclockwise about the handle rotation shaft 322*a*. In addition, the pressing part 321 further presses the horizontal part 331, and the push slider 33 may be moved further in the rear direction.

At this time, the rear end of the push slider 33 is in contact with the front surface of the cabinet 10 and pushes the front surface of the cabinet 10 according to the rotation amount of the door handle 32 to move the door 20 in the front direction. In addition, the door handle 32 acts like a lever so that a force greater than a force pulling the door handle 32 is transmitted to the push slider 33 so that the push slider 33 strongly pushes the cabinet 10 to move the door 20 in the front direction.

In other words, when the user grips and pulls the lower part of the door handle 32, the push slider 33 pushes the cabinet 10 with greater force by the door handle 32 and thus the door 20 can be opened. Accordingly, the user can open the door 20 with less force despite the magnetic force of the magnet 243 and the generation of negative pressure inside the storage space.

After the gasket 24 is separated from the cabinet 10, the user can rotate the door 20 in a state of gripping the door handle 32, and the storage space can be completely opened.

In a state where the door 20 is opened, a user can perform a desired operation, and after the food storage operation is completed, the storage space can be closed by rotating the door 20.

When the door handle 32 is released after the door 20 is opened, the door handle 32 rotates clockwise about the handle rotation shaft 322*a* by the elastic restoring force of the spring 34. and the push slider 33 moves in the front direction.

In other words, the door opening device 30 can be returned to the state illustrated in FIGS. 9 and 10, and the door 20 is naturally closed to shield the storage space in an airtight state.

Meanwhile, the refrigerator according to an embodiment of the present disclosure may have various other embodiments in addition to the above-described embodiments. Another embodiment of the present disclosure is characterized in that a door opening device is provided on a door of a refrigerator in which a pair of doors are disposed side by side on both sides in the left and right direction. In another embodiment of the present disclosure, only the structure of the door and the cabinet on which the door opening device is disposed may be different, but the configuration of the door opening device may be the same. In addition, the same components as those of the above-described embodiment are denoted by the same reference numerals, and detailed descriptions thereof will be omitted.

Figure 15:
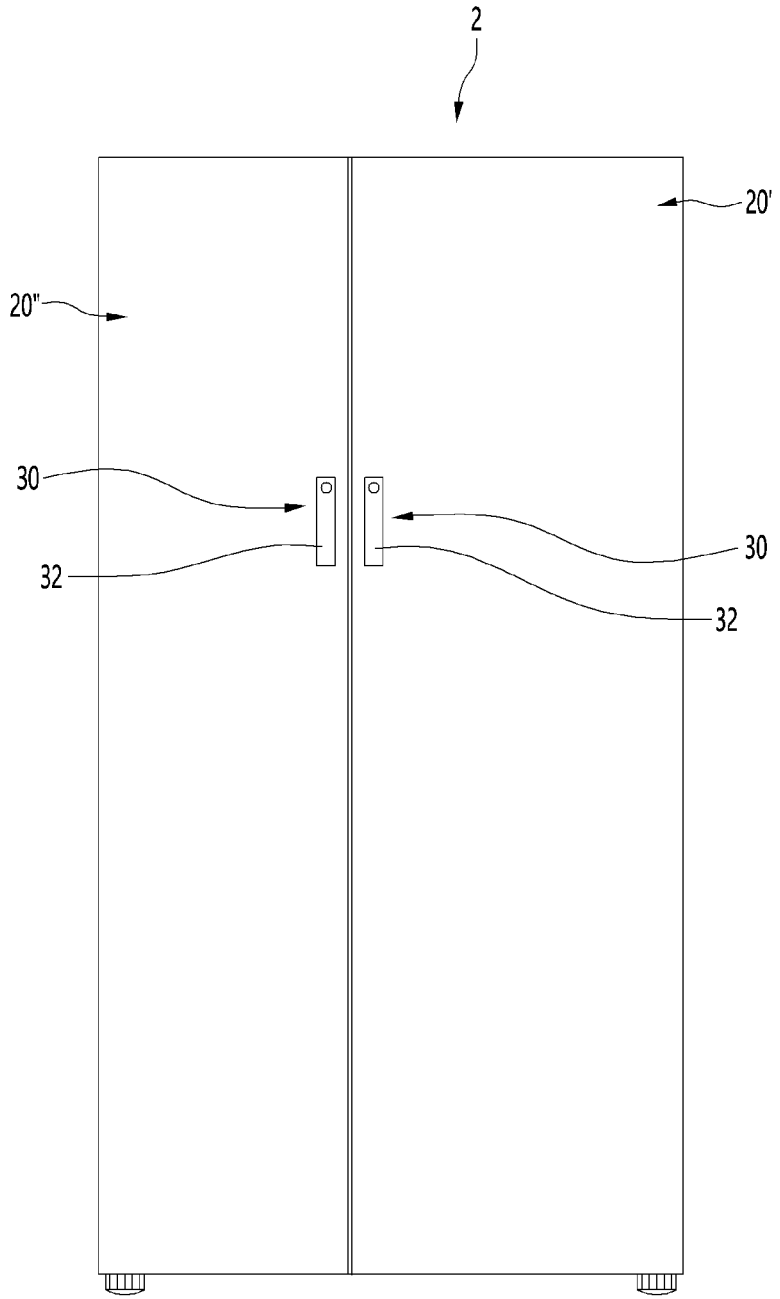
FIG. 15 is a perspective view illustrating a refrigerator according to another embodiment of the present disclosure.
Figure 16:
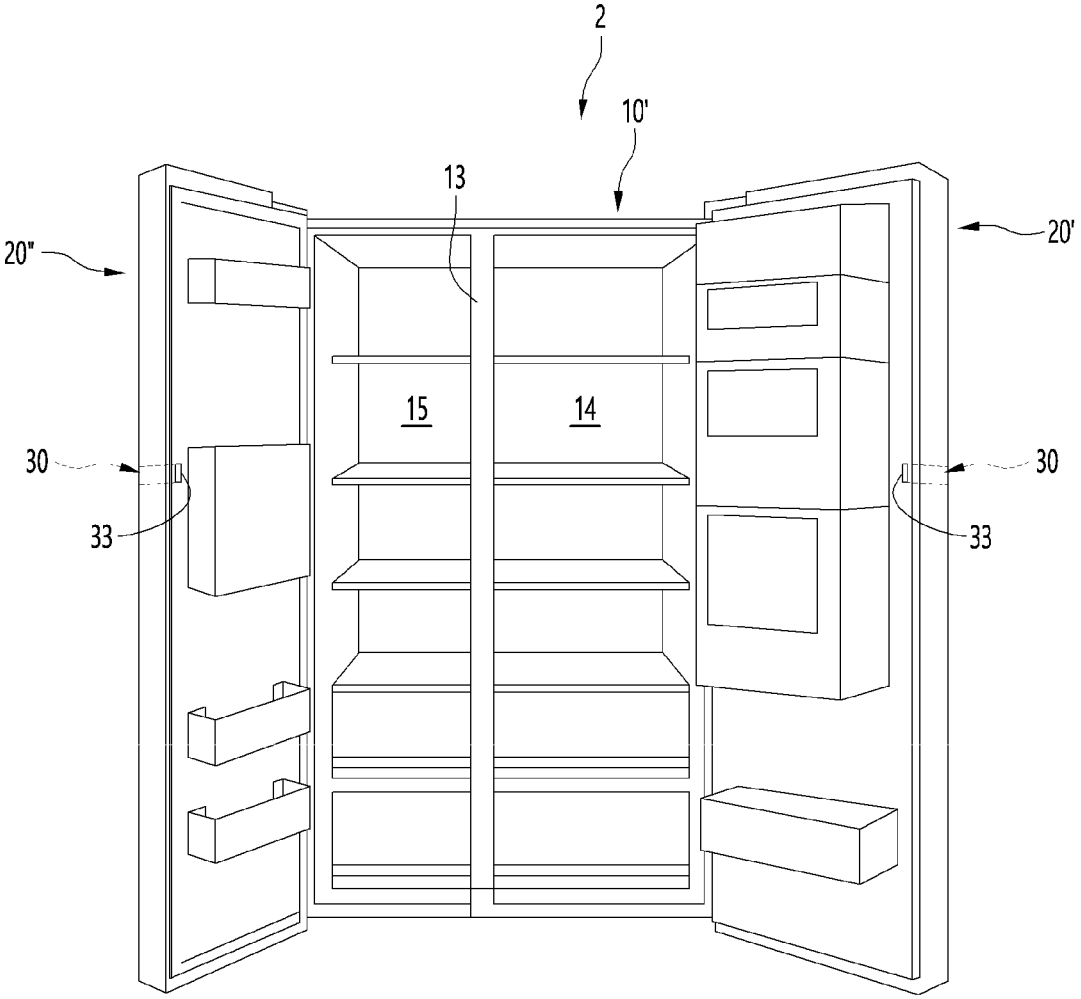
FIG. 16 is a front view illustrating a state where the door of the refrigerator is opened.

FIG. 15 is a perspective view illustrating a refrigerator according to another embodiment of the present disclosure, and FIG. 16 is a front view illustrating a state where the door of the refrigerator is opened.

As illustrated in the drawing, a refrigerator 2 according to another embodiment of the present disclosure may include a cabinet 10' forming storage spaces 14 and 15 and a door 20' and 20" opening and closing the storage spaces 14 and 15. The storage spaces 14 and 15 may be partitioned on left and right sides by a barrier 13 to form a freezing chamber 15 and a refrigerating chamber 14, respectively.

In addition, the doors 20' and 20" may include a refrigerating chamber door 20' for shielding the refrigerating chamber 14 and a freezing chamber door 20" for shielding the freezing chamber 15. The refrigerating chamber door 20' and the freezing chamber door 20" may be rotatably mounted to the cabinet 10', respectively, and can independently open and close the refrigerating chamber 14 and the freezing chamber 15 by rotation.

In addition, the door opening device 30 may be provided at the refrigerating chamber door 20' and the freezing chamber door 20". The door opening device 30 may be the same as that of the above-described embodiment and may be disposed on the far side from the rotation shaft of each of the refrigerating chamber door 20' and the freezing chamber door 20". In other words, the door opening device 30 may be provided at an end portion at which the refrigerating chamber door 20' and the freezing chamber door 20" are adjacent to each other, respectively. In addition, the door opening device 30 provided in the refrigerating chamber door 20' and the freezing chamber door 20", respectively, has the same structure and may be disposed at the same height.

The door handle 32 of the door opening device 30 may be located at the front surface of the refrigerating chamber door 20' and the freezing chamber door 20", and the push slider 33 protruding rearward by manipulation of the door handle 32 may be disposed so as to be in contact with the barrier 13.

Accordingly, when the door handle 32 is manipulated to open the doors 20' and 20", the push slider 33 pushes the front surface of the barrier 13 and the doors 20' and 20" can be opened. To this end, the door opening device 30 may be disposed such that the push slider 33 is positioned in front of the barrier 13.

According to the refrigerator according to the embodiment of the present disclosure, the following effects can be expected.

A door opening device for opening the door may be embedded in the door, and the door handle may be disposed on the same plane as the front surface of the door. Accordingly, it is possible to provide a clean outer appearance without a protrusion portion on the outer appearance of the front surface of the door.

In addition, when the upper part of the door handle is pressed to open the door, the door handle is rotated and the lower part thereof protrudes, and the user can open the door by holding the protruding lower part thereof and pulling the door.

In other words, there are advantages that, in a state where the door is closed, there is no protrusion portion on the front surface of the door, so the outer appearance thereof is improved, and in order to open the door, and that the door can be opened by pulling the door handle only by simple manipulation of the door handle.

In particular, when the door handle is pulled, while the door handle rotates, the door handle pushes the push slider to move the push slider in the rear direction, and the push slider pushes the cabinet to assist in opening the door.

Therefore, even in a state where the gasket of the door is in close contact with the cabinet and the inside of the storage space is in a negative pressure state, the door can be easily opened, thereby increasing convenience in use.

In particular, the process of protruding the door handle in a state of being disposed inside the door, the process of pulling the door handle, and the process of pushing the cabinet by the slider linked to the door handle can be linked in one operation, and thus there is an advantage that faster and more convenient door opening manipulation becomes possible.

In addition, the door handle is formed so that the distance from the rotation shaft of the door handle to the upper end in contact with the push slider is shorter than the distance from the rotation shaft to the lower end of the door handle, and therefore, with less force due to the principle of the lever, it is possible to open the door by pulling the door handle, thereby improving convenience in use.

In addition, the push slider may be supported by a spring to maintain a state where the door handle shields the opening of the front side of the door in a state where the door handle is not manipulated. In addition, when the door handle is released after completing the manipulation of the door handle, the door handle is automatically returned to the original position thereof by the spring.

In addition, the structure of the door opening device may be formed at an intermediate point spaced apart from the upper and lower ends of the door, thus simplifying the structure of the door handle and preventing deterioration in outer appearance due to the door handle.

In particular, the door handle may be formed to shield the opening of the front surface of the door, and by forming the same plane as the front surface of the door, the outer appearance of the front surface of the door may have a sense of unity.

In addition, the push slider is formed to pass through the opening on the rear surface of the door formed on the outer surface of the gasket, so that the insulation performance of the moving structure of the push slider can be prevented from being deteriorated. In addition, all the remaining configurations of the door opening device except for a portion of the rear end of the push slider and a portion of the front surface of the door handle are configured to be located inside the door, so that the outer appearance of the door can be seen more concisely.

In addition, the door opening device has a simple structure in which the door handle and the push slider are disposed to be interlocked in a space formed by the case inside the door, and thus has an advantage that assembly and productivity can be improved.

In addition, in the process of rotating the door handle so that the lower part of the door handle protrudes before pulling the door handle, the rear end of the push slider is formed so as not to contact the front surface of the cabinet so that excessive force is not applied during the initial manipulation of the door handle, and thus the effect of improving the user's manipulation convenience for opening the door can be expected.

What is claimed is:

1. A refrigerator comprising:

a cabinet that defines a storage space;

a door configured to open and close at least a portion of the storage space, the door comprising a door plate that defines a front surface of the door having a front opening, wherein the door has a rear opening defined at a rear surface of the door; and a door opening device disposed at the door and configured to be manipulated by a user to open the door, the door opening device comprising:

a case that is disposed inside the door and in communication with the front and rear openings of the door, a door handle disposed inside the case and configured to be rotated about a handle rotation shaft by the user, and a push slider accommodated in the case and configured to reciprocate along a straight line, the push slider having a first end configured to contact the door handle and a second end configured to protrude through the rear opening of the door, wherein the door handle comprises:

a front surface configured to cover the front opening of the door plate and be coplanar with the front surface of the door plate based on the door handle being located at a first position before the door handle is manipulated by the user, an upper portion configured to be pushed by the user to thereby rotate the door handle from the first position to a second position, and a lower portion located below the upper portion and configured to protrude forward relative to the front surface of the door plate based on the upper portion being pushed by the user, and wherein the door handle is configured to, based on the lower portion protruding forward relative to the front surface of the door plate and being pulled by the user, further rotate forward from the second position to cause the push slider to move rearward to thereby push the cabinet and open the door.

2. The refrigerator of claim 1, further comprising a hinge device that is disposed at at least one of an upper end of the door or a lower end of the door and rotatably connects the door to the cabinet, the hinge device being disposed at a first lateral side of the door in a left-right direction of the door, wherein the door opening device is disposed at a second lateral side of the door disposed away from the hinge device in the left-right direction of the door.

3. The refrigerator of claim 1, wherein the door comprises:

a door liner that defines the rear surface of the door;

a cap decoration that connects upper and lower ends of the door plate to the door line; and an insulation material provided in a space defined by the door plate, the door liner, and the cap decoration, and wherein the case defines an accommodation space in which the insulation material is not provided.

4. The refrigerator of claim 3, further comprising a gasket that is arranged along a periphery of the rear surface of the door liner and configured to contact the cabinet, the gasket being configured to seal a space between the storage space and the door.

5. The refrigerator of claim 4, wherein the push slider is configured to protrude to an outside of the gasket through the rear surface of the door.

6. The refrigerator of claim 3, wherein the accommodation space of the case is in contact with the front surface of the door and side surfaces of the door, and wherein the door handle is configured to rotate in the accommodation space, and the push slider is configured to reciprocate in the accommodate space.

7. The refrigerator of claim 3, wherein the door plate defines the front opening of the door, the front opening being in communication with the accommodation space, and wherein a size of the front opening corresponds to a size of the door handle such that the door handle covers at least the portion of the front opening.

8. The refrigerator of claim 3, wherein the door plate comprises:

a front part that defines the front surface of the door;

side parts that define side surfaces of the door; and a coupling part that is bent from one of the side parts and defines a circumference of the rear surface of the door, the coupling part being coupled to the door liner, and wherein the coupling part defines a slider outlet configured to receive the push slider, the slider outlet corresponding to the rear opening.

9. The refrigerator of claim 8, wherein the case defines:

a handle accommodation space that is opened toward the front part of the door plate and configured to accommodate the door handle; and a slider accommodation space that is in communication with the handle accommodation space and opened toward one of the side parts, the slider accommodation space extending to the rear surface of the door and being configured to accommodate the push slider.

10. The refrigerator of claim 1, wherein the handle rotation shaft is disposed at a rear surface of the door handle, is rotatably coupled to the case, and protrudes from sides of the door handle, the door handle being configured to rotate about the handle rotation shaft in a front-rear direction.

11. The refrigerator of claim 10, wherein the door handle further comprises a pressing protrusion that is disposed at the rear surface of the door handle, that protrudes from the rear surface of the door handle, and that is disposed at the upper portion of the door handle, the pressing protrusion being configured to contact the push slider based on rotation of the door handle.

12. The refrigerator of claim 11, wherein the door handle further comprises a pressing part that is disposed at the front surface of the door handle and disposed at the upper portion, the pressing part being configured to indicate a position of the door handle to be manipulated by the user.

13. The refrigerator of claim 10, wherein the push slider comprises:

a horizontal part accommodated in the case and configured to contact the upper portion of the door handle; and a vertical part that extends rearward from an end portion of the horizontal part, the vertical part being configured to pass through the rear surface of the door and contact the cabinet.

14. The refrigerator of claim 13, further comprising a spring disposed in the case and configured to support a rear side of the horizontal part of the push slider, and wherein the spring is configured to be compressed based on the push slider moving rearward.

15. The refrigerator of claim 14, wherein the case defines a spring mounting protrusion that protrudes through the spring, and wherein the horizontal part of the push slider defines a guide hole that receives the spring mounting protrusion, the guide hole being configured to guide movement of the push slider in the front-rear direction.

16. The refrigerator of claim 14, wherein the spring is configured to, based on the door handle not being manipulated, support the push slider to thereby separate a rear end of the push slider from the cabinet.

17. The refrigerator of claim 10, wherein a distance from the handle rotation shaft to a lower end of the door handle is greater than a distance from the handle rotation shaft to an upper end of the door handle.

18. The refrigerator of claim 1, further comprising:

a barrier that partitions the storage space into a left storage space and a right storage space;

a left door configured to open and close the left storage space; and a right door configured to open and close the right storage space, wherein the door is one of the left door or the right door, and wherein the push slider is configured to protrude toward the barrier through the rear surface of the door.

19. The refrigerator of claim 18, further comprising:

a left door opening device disposed at a right side of the left door and configured to protrude toward the barrier through the rear surface of the left door; and a right door opening device disposed at a left side of the right door and configured to protrude toward the barrier through the rear surface of the right door, wherein the door opening device is one of the left door opening device or the right door opening device, and wherein the left and right door opening devices are disposed adjacent to each other in a left-right direction and disposed at a same height with respect to a bottom of the cabinet.

20. The refrigerator of claim 1, wherein the upper portion of the door handle is located above the handle rotation shaft, and the lower portion of the door handle is located below the handle rotation shaft.

* * * * *